US005742309A

United States Patent [19]

Tajima et al.

[11] Patent Number: 5,742,309

[45] Date of Patent: Apr. 21, 1998

[54] INK CARTRIDGE

[75] Inventors: Hiroki Tajima, Kawasaki; Masami Ikeda, Yokohama; Tsutomu Abe, Isehara; Toshio Kashino, Chigasaki; Masahiko Higuma, Tohgane; Takeshi Okazaki, Sagamihara, all of Japan

[73] Assignee: Canon Kabushiki Kaisha, Tokyo, Japan

[21] Appl. No.: 292,198

[22] Filed: Aug. 19, 1994

[30] Foreign Application Priority Data

Aug. 20, 1993 [JP] Japan ..... 5-206302

[51] Int. Cl.[6] ..... B41J 2/175

[52] U.S. Cl. ..... 347/86

[58] Field of Search ..... 347/87, 86, 20

[56] References Cited

U.S. PATENT DOCUMENTS

| | | | |
|---|---|---|---|
| 3,967,286 | 6/1976 | Andersson et al. | 347/87 |
| 4,794,409 | 12/1988 | Cowger et al. . | |
| 5,051,759 | 9/1991 | Karita et al. . | |
| 5,155,502 | 10/1992 | Kimura et al. . | |
| 5,182,581 | 1/1993 | Kashimura et al. | 347/87 |
| 5,502,479 | 3/1996 | Ishinaga et al. | 347/87 |

FOREIGN PATENT DOCUMENTS

| | | | |
|---|---|---|---|
| A42156 | 2/1994 | Australia . | |
| A70323 | 5/1995 | Australia . | |
| 0493058 | 7/1992 | European Pat. Off. . | |
| 0536980 | 4/1993 | European Pat. Off. . | |
| 0562733 | 9/1993 | European Pat. Off. . | |
| 0580433 | 1/1994 | European Pat. Off. . | |
| 2-281956 A | 11/1990 | Japan | 347/87 |
| 47157 | 1/1992 | Japan | B41J 3/04 |

*Primary Examiner*—Benjamin R. Fuller
*Assistant Examiner*—Judy Nguyen
*Attorney, Agent, or Firm*—Fitzpatrick, Cella, Harper & Scinto

[57] ABSTRACT

An ink cartridge for supplying ink to a recording head includes a vacuum producing material accommodating portion for accommodating a vacuum producing material; an ink containing portion for containing ink, adjacent the material accommodating portion, with which the ink containing portion is in fluid communication through an opening at a bottom portion; an ink supply opening for permitting supply of the ink, in the material accommodating portion; an inward projection in the ink containing portion; and the projection is not less than 0.2 mm away from a boundary between the material accommodating portion and the ink containing portion.

3 Claims, 3 Drawing Sheets

INK CARTRIDGE

FIELD OF THE INVENTION AND RELATED ART

The present invention relates to an ink cartridge for containing ink to be supplied to a recording head, which is detachably mountable to the recording head, or to the recording apparatus.

An ink jet recording apparatus, particularly an ink jet recording apparatus using thermal energy for ejecting ink, is widely used with various apparatuses such as printers, facsimile machines, copying machines or the like, as a means for recording on a recording material.

From the standpoints of apparatus downsizing, cost reduction, maintenance free or the like, a cartridge type recording means in which a recording head and an ink container are connected and are detachably mountable to a carriage in a recording apparatus.

The cartridge type recording means includes two types, in one of which the recording head and the ink container are unified, and in the other of which the recording head and the ink container are separate but are unified on the carriage. Recently, the service life of a recording head is extended as compared with the ink capacity of the ink container, the latter type cartridge is noted.

As for the structures of the exchangeable ink containers, there are various types, in one of which an ink absorbing material occupies substantially the entirety of the ink containing space to provide the recording head with a desired vacuum, which will be called hereinafter "full-sponge type". In another type, the ink absorbing material occupies approximately one half of the ink containing space. This has been proposed for the purpose of increasing the ink capacity. This will be called "half-sponge type".

In a further example, the inside of the ink container is filled with the liquid ink only for the purpose of further increasing the ink capacity, in which the vacuum is provided by another mechanism. This will be called "full-ink type".

Among these types, the present invention is directed to a half-sponge type cartridge with which the ink capacity is relatively large, and the vacuum generation is relatively easy.

Referring to FIG. 1, there is shown an example of a half sponge type ink cartridge in a perspective sectional view. The main body 1 of the ink cartridge is provided with an ink supply port 2 for connection with an ink jet recording head, and an air vent 10 for introducing the ambient air, provided above the ink supply port 2. It comprises a vacuum producing material containing portion 4 for containing the vacuum producing member such as a water absorbing sponge or the like for retaining the recording ink, and an ink accommodating portion 6 for containing ink, adjacent the vacuum producing material accommodating portion 4 through a rib 5. An ink containing portion 6 and the vacuum producing material accommodating portion 4 are in fluid communication with each other through a clearance 8 formed between the rib 5 and the bottom surface. The bottom surface of the ink container 6 is provided with an ink supply port 7 for filling the initial ink. After the filling of the ink, the port 7 is sealed by an unshown sealing member.

With the structures described above, the ink supplied into the ink container 6 through the supply port 7 is also retained in a desired region of the negative pressure generating member 3 in the negative pressure generating material accommodating portion 4. It is supplied to a recording head through an unshown ink supply tube contacted to the material 4, through the ink supply port 2. In accordance with the amount of ink consumption, the material 3 absorbs the ink in the ink containing portion 6, and a corresponding amount of air is introduced into the ink container 6 from the air vent 10 through the accommodating portion 4, thus maintaining the ink supply to the recording head.

The ink container 6 is constituted by orthogonal flat walls, so that a relatively large amount of the ink can be contained. The bottom surface of the ink container 6 is flat to provide smooth flow of the ink.

Because of the recent downsizing and the transportability of the recording apparatus, the position of the recording apparatus varies very much, for example, when the recording apparatus is not used, it may be placed upside down. In addition, it can be placed for a long term under various ambient conditions. These situations increase the possibility of leakage of the ink from the ink cartridge.

FIG. 2 illustrates ink leakage when the ink cartridge is placed upside down, and ambient condition change occurs.

More particularly, it is placed upside down in a thermostatic chamber under 60° C. The ink hardly moves when the ink is not used at all, that is, the ink container 6 is full of the ink. However, if the ink in the ink container 6 decreases to provide a gap between the ink level surface and the internal surface of the cartridge body, the water vapor from the ink is condensed into dew deposited on the bottom surface which is now at the top. Then, since the vacuum producing portion 4 which is under a negative pressure absorbs the dew through the clearance 8. By repeating these steps, the ink moves from the ink container 6 to the portion 4, with the result that the container 4 is filled with the ink. When this state is reached, the ink may leak through the ink supply port 2 or the air vent 10.

The corners of the ink accommodating portion are not rounded so that the ink is taken by the capillary force provided by the corners, so that the ink moves into the vacuum producing material accommodating portion 4 by the negative pressure therein.

SUMMARY OF THE INVENTION

Accordingly, it is a principal object of the present invention to provide an improved ink cartridge.

It is another object of the present invention to provide an ink cartridge with which the ink does not leak even if it is placed upside down.

It is a further object of the present invention to provide an ink cartridge with which the ink does not leak even if the ambient condition changes.

It is a yet further object of the present invention to provide an ink cartridge with which the ink movement is substantially prevented toward a vacuum generating material accommodating portion, so that the ink does not leak through an ink supply port or an air vent.

According to an aspect of the present invention, there is provided an ink cartridge for supplying ink to a recording head, comprising: a vacuum producing material accommodating portion for accommodating a vacuum producing material; an ink containing portion for containing ink, adjacent the material accommodating portion, with which the ink containing portion is in fluid communication through an opening at a bottom portion; an ink supply opening for permitting supply of the ink, in the material accommodating portion; an inward projection in the ink containing portion; and the projection is not less than 0.2 mm away from a boundary between the material accommodating portion and the ink containing portion.

According to this aspect, the dew drops deposited on the bottom surface in the ink container are prevented from moving to the vacuum producing material accommodating portion and are returned to the ink container.

According to another aspect of the present invention, corners in the ink container is curved, thus preventing occurrence of the capillary force. Therefore, the ink is not moved up, thus further preventing the movement of the ink. Therefore, the ink leakage can be further prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
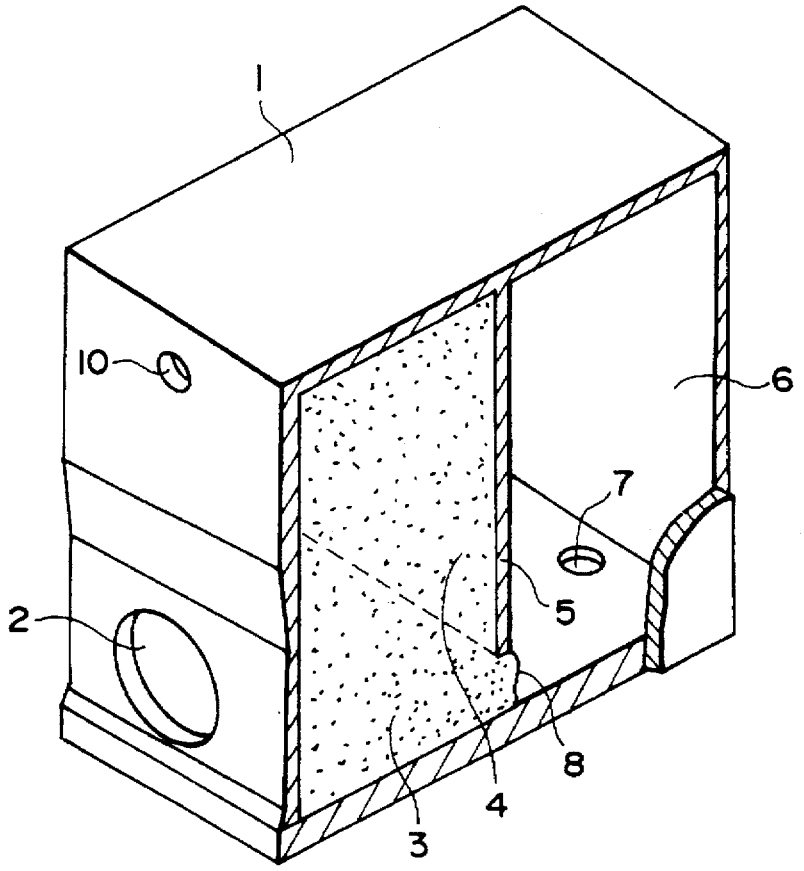
FIG. 1 PRIOR ART
FIG. 1 is a perspective sectional view of a conventional ink cartridge.
Figure 2:
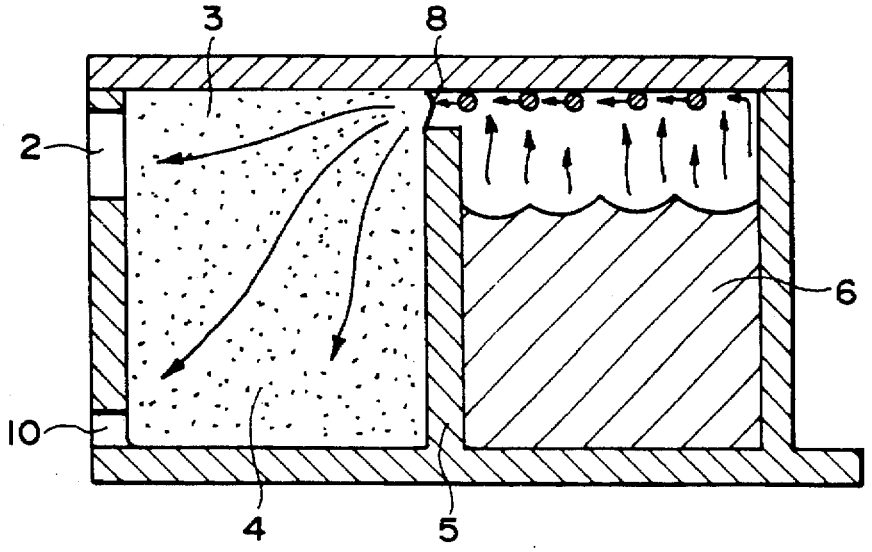
FIG. 2 PRIOR ART
FIG. 2 is a sectional view illustrating leakage of the ink in the conventional ink cartridge.
Figure 3:
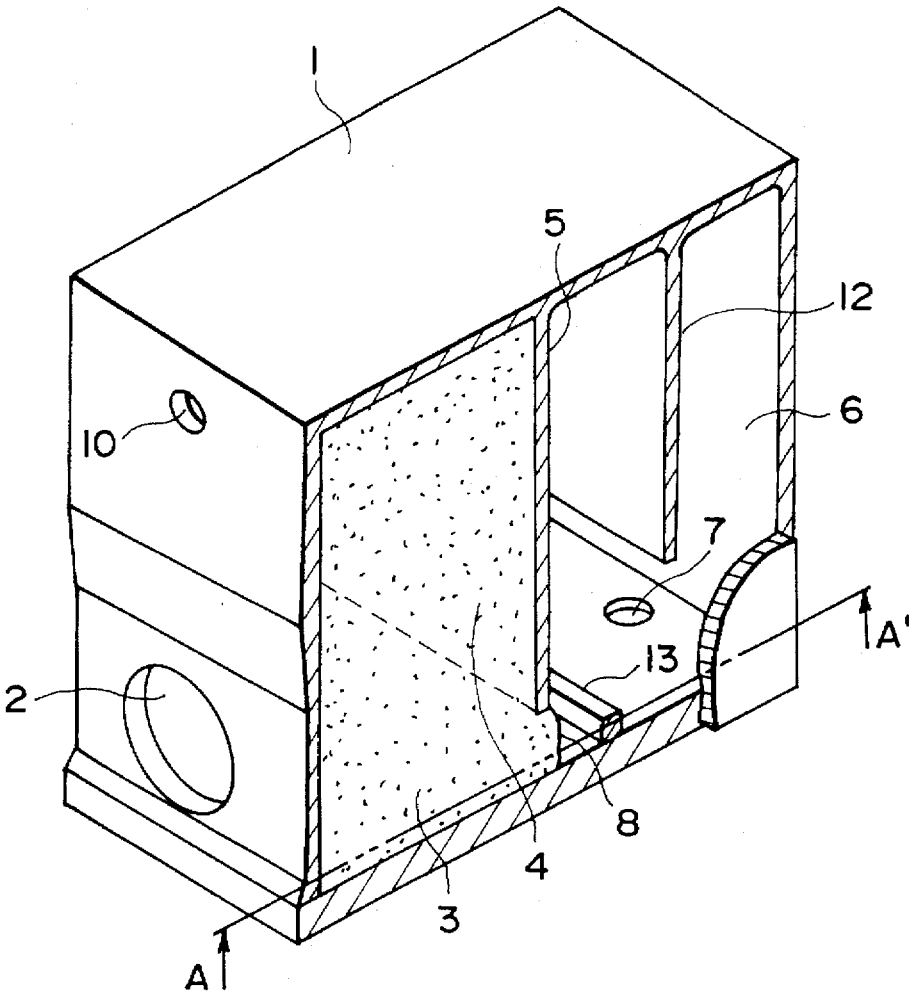
FIG. 3 is a perspective sectional view of an ink cartridge according to an embodiment of the present invention.
Figure 4:
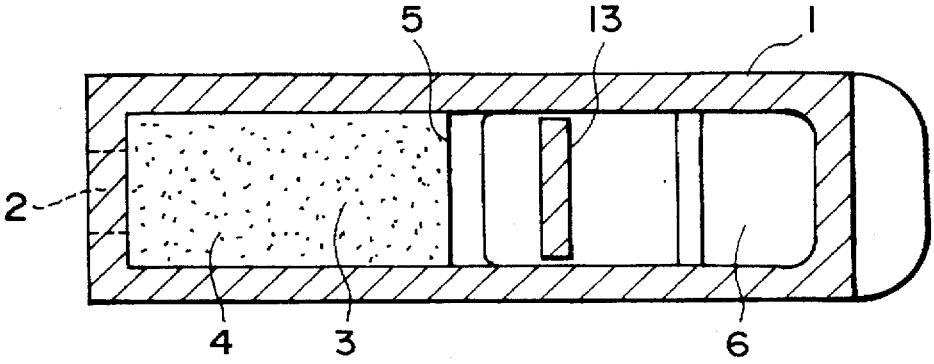
FIG. 4 is a sectional view of an ink cartridge according to the embodiment of the present invention.
Figure 3:
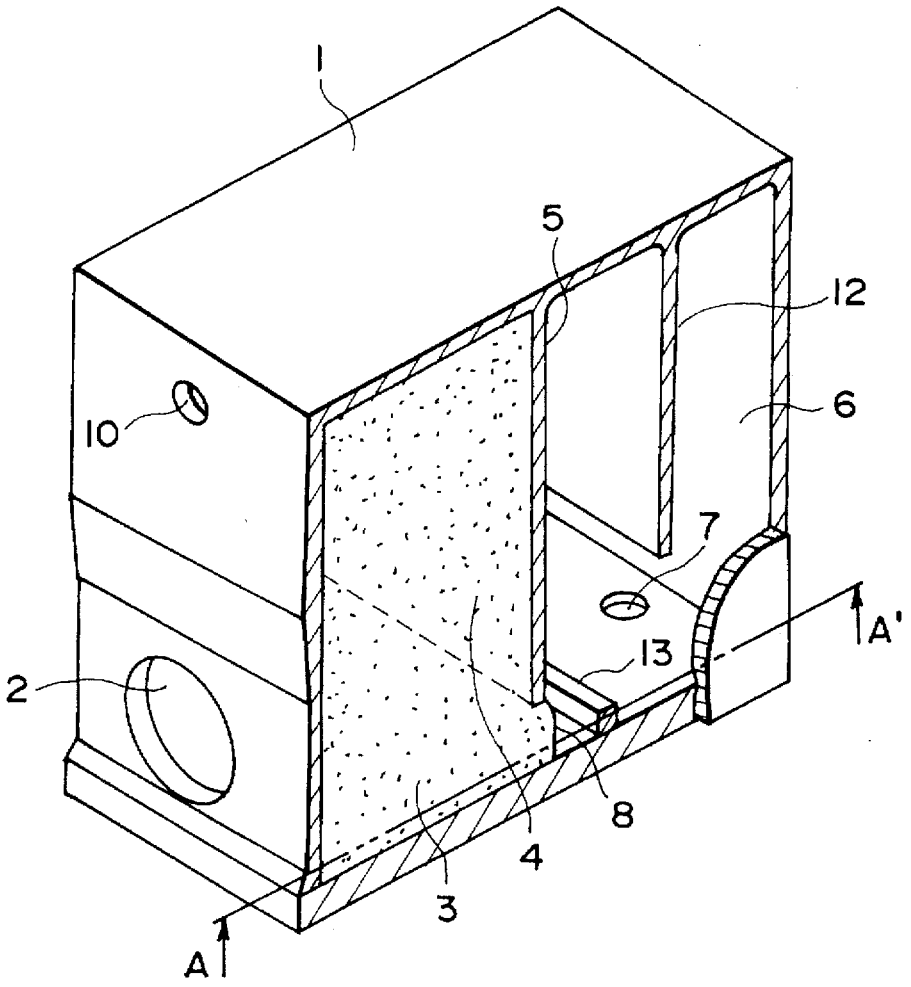
Figure 4:
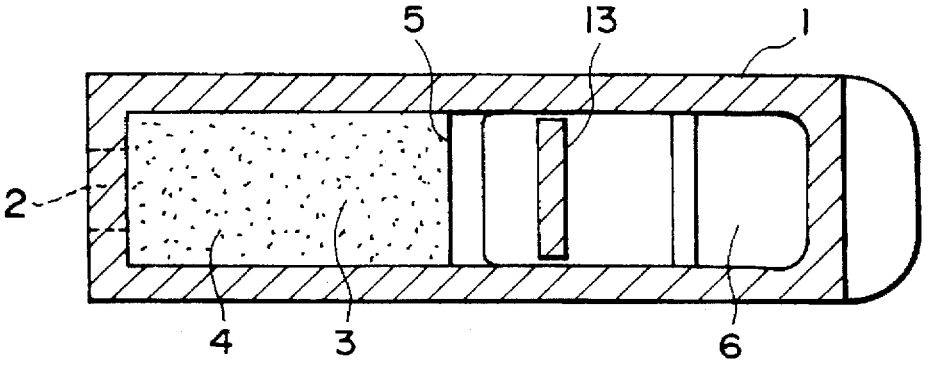
Figure 5:
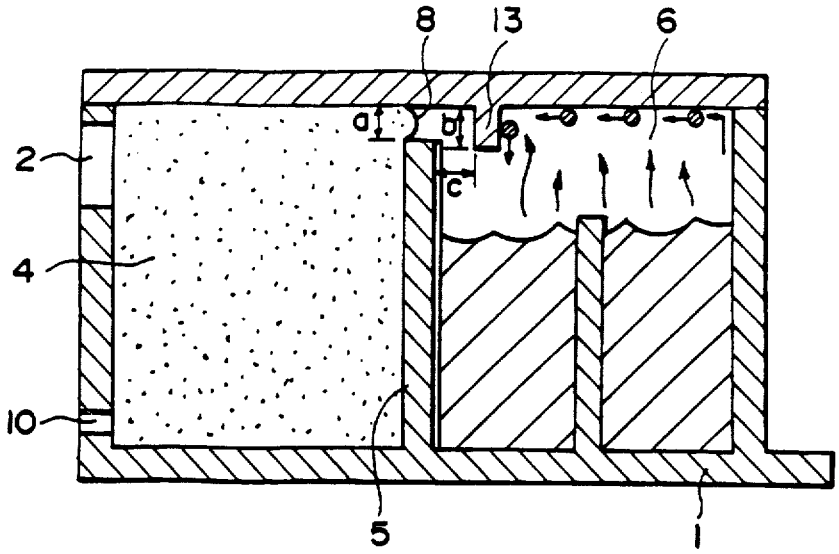
FIG. 5 illustrates prevention of the ink leakage according to the present invention.

FIG. 3 is a perspective sectional view of an ink cartridge according to an embodiment of the present invention, FIG. 4 is a cross-sectional view of the same, and FIG. 5 illustrates the prevention of the ink leakage in the embodiment. The same reference numerals as in FIGS. 1 and 2 are assigned to the elements having the corresponding functions, and the detailed description thereof is omitted for simplicity.

In this embodiment, the ink container portion 6 in fluid communication with the vacuum producing material accommodating portion 4 through a clearance 8 at the bottom portion, is provided with a partition rib 12 extending in a top half portion and one or more plate-like projections 13 extending from the bottom into the inside.

The corner formed by adjacent side inner surfaces of the ink containing portion 6, a corner formed by an internal side surface of the ink containing portion 6 and the projection 13, and a corner formed between an internal side surface and the partition rib 12, are curved so that smooth surface is formed therebetween. The curvature is determined such that the capillary force is not produced by the corners.

The ink cartridge is placed upside down in a thermostatic chamber under 60° C. As will be understood from FIG. 5, the dew drops produced by evaporation of the ink in the ink containing portion 6 fall along the projection 13, and do not move into the vacuum producing material accommodating portion 4.

Additionally, when the ink cartridge is placed upside down, the corners extending vertically are rounded so that the capillary force is not produced, thus assuring the movement of the ink from the ink containing portion 6 into the accommodating portion 4, with certainty.

As show in FIGS. 4 and 5, the projection 13 is disposed away from the rib 5 by c and has a height b. In order to permit use-up of the ink containing portion 6, a part of the projection 13 is cut away. In the example of FIG. 4, opposite ends of the projection 13 provide the gap.

The height b of the projection 13 is so selected that the evaporated ink does not easily go over the projection 13, more particularly, it is approx. 1–3 mm. In it is too high, the ink supply during the normal recording may be deteriorated particularly when the quantity of the ink reduces, since the ink supply is permitted only through the cut-away portion.

The height a of the clearance 8 between the rib 5 and the ink cartridge is approx. 1.5 mm, and the height b is preferably larger than the height a, since then, the circumvention of the evaporated ink can be properly prevented.

As regards the distance c between the rib 5 and the projection 13, if it is too short, the ink supply during the normal recording is deteriorated because of increased flow resistance and the resulting poor air-liquid exchange. If it is too long, the evaporated ink limitation effect is insufficient. More particularly, if the distance c is long, the evaporated ink is condensed on the portion, and may reach the material accommodating portion 4. For these reasons, it is preferably approx. 0.2–1.5 mm.

The structure is particularly usable with the half-sponge type ink cartridge. For example, it is usable in a recording head cartridge having an integral ink container. It is also usable for a large size ink containing chamber, as shown in FIG. 6.

Figure 6:
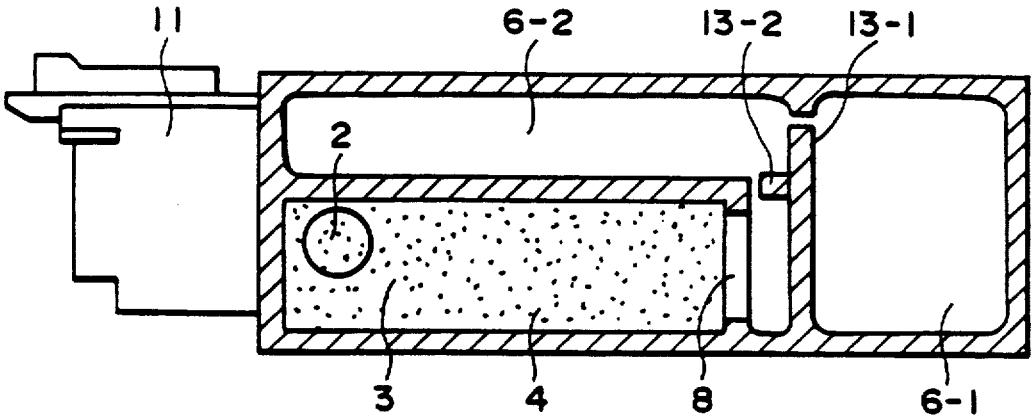
FIG. 6 is a sectional view of an ink cartridge according to another embodiment of the present invention.

In FIG. 6, the ink containing chamber 6 is provided around the vacuum producing material accommodating portion 4. In this example, the ink containing portion 6 is generally L-shaped having faces common with the material accommodating portion 4.

The L-shaped ink containing portion 6 is provided with first and second projections indicated by reference numerals 13-1 and 13-2. The projection 13-1 generally divides the ink containing portion into large parts 6-1 and 6-2 to prevent circumvention of the evaporated ink from the ink containing portion 6-1. The projection 13-2 is intended to prevent circumvention of the evaporated ink from the ink containing portion 6-2.

Each of the projections 13-1 and 13-2 is provided with a groove or grooves to permit consumption of the entirety of the ink from the ink containing portions 6-1 and 6-2.

For these projections 13-1 and 13-2, the height b, the clearance 8 and the distance c are determined under substantially the same conditions as in FIG. 5 embodiment.

In addition, the intersection between internal walls of the ink cartridge are curved to prevent the circumvention of the ink along the corners, and therefore, it is preferable.

In the foregoing, the description has been made as to the structure in which the ink cartridge is placed upside down. However, the ink cartridge may be placed another way, for example, the material accommodating portion 4 is at the bottom, the ink containing portion 6 is at the bottom.

Therefore, it would be considered that the optimum position of the projection 13 is different depending on in what way the ink cartridge is placed. However, if the projection 13 is provided on the bottom surface when the ink cartridge is used, the ink leakage can be effectively prevented.

As described in the foregoing, according to the present invention, even if the ink cartridge is placed upside down under high temperature room such as 60° C., the dew droplets produced by the evaporation of the ink in the ink containing portion falls along the projection from the bottom surface of the ink containing portion, and therefore, do not move into the vacuum producing material accommodating portion.

By providing a curved surface at the meeting portions of the vertical inner surfaces, the capillary action does not occur at the corners otherwise formed, so that the movement of the ink from the ink containing portion into the vacuum producing material accommodating portion can be prevented with further certainty. Therefore, even if the ink cartridge is kept under the above-described extreme conditions, the ink leakage through the ink supply port or the air vent can be prevented, while the ink can be supplied into the recording head is stability during the recording operation, thus improving the reliability.

While the invention has been described with reference to the structures disclosed herein, it is not confined to the details set forth and this application is intended to cover such modifications or changes as may come within the purposes of the improvements or the scope of the following claims.

What is claimed is:

1. An ink cartridge for supplying ink to an ink jet recording head, comprising:

a first chamber containing negative pressure producing material and having an ink outlet connectable to the ink jet recording head to supply ink from the cartridge to the ink jet recording head and an air vent for allowing air into the cartridge;

a second chamber having a communication port and an interior bounded by inner surfaces, said second chamber and said first chamber being separated by a partition portion therebetween, said partition portion having a bottom portion, said communication port being disposed at the bottom portion of the partition portion, said second chamber communicating with the first chamber through said communication port and providing an ink reservoir for said first chamber; and an inward projection in said second chamber, said projection extending at least substantially the length of a width of said second chamber and being adjacent to the bottom portion of said partition portion, said projection being located between 0.2 mm and 1.5 mm away from the bottom portion of said partition portion.

2. An ink cartridge according to claim 1, wherein said projection has a height approximately in a range 1–3 mm.

3. An ink cartridge according to claim 1, wherein said interior of said second chamber has intersection portions where said inner surfaces meet, said intersection portions being rounded.

* * * * *

UNITED STATES PATENT AND TRADEMARK OFFICE

CERTIFICATE OF CORRECTION

PATENT NO. : 5,742,309

DATED : April 21, 1998

INVENTORS : Hiroki Tajima et al.

It is certified that error appears in the above-identified patent and that said Letters Patent is hereby corrected as shown below:

ON TITLE PAGE

[56] References Cited US. Documents

Insert "5,619,238 4/1997 Higuma et al...347/86";

IN THE DRAWINGS

Replace Sheet 3 of 3 with the attached new Sheet 3 of 3 which includes Figs. 5 and 6.

Column 1 line 44, "half" should read --half- --.

Column 3 line 8, "is" should read -- are--.

Column 4 line 8, "In" should read --If--.

UNITED STATES PATENT AND TRADEMARK OFFICE

CERTIFICATE OF CORRECTION

PATENT NO. : 5,742,309

DATED : April 21, 1998

INVENTORS : HIROKI TAJIMA ET AL.

It is certified that error appears in the above-identified patent and that said Letters Patent is hereby corrected as shown below:

COLUMN 5 line 14, "can be" should read --is--; and
line 15, "stability" should read --stable--.

Signed and Sealed this

Seventeenth Day of November, 1998

*Attest:*

BRUCE LEHMAN

*Attesting Officer*

*Commissioner of Patents and Trademarks*